US005692237A

United States Patent [19]

Bennett

[11] Patent Number: 5,692,237

[45] Date of Patent: Dec. 2, 1997

[54] WEAPON CONCEALMENT SYSTEM

[76] Inventor: Richard G. Bennett, 14334 Ferndale Rd., Woodbridge, Va. 22193

[21] Appl. No.: 646,150

[22] Filed: May 7, 1996

[51] Int. Cl.[6] ..... A41D 1/00

[52] U.S. Cl. ..... 2/93; 2/94; 2/250; 224/192; 224/196; 224/238; 224/911

[58] Field of Search ..... 2/93, 94, 102, 2/108, 85, 247, 249, 250–253; 224/911, 912, 682, 683, 192, 196, 243, 238

[56] References Cited

U.S. PATENT DOCUMENTS 2,810,132 10/1957 Nicholson ..... 224/911

4,966,320 10/1990 DeSantis et al. ..... 224/911

5,294,031 3/1994 Volpei et al. ..... 224/911

5,431,318 7/1995 Garcia ..... 224/911

*Primary Examiner*—Gloria Hale

*Attorney, Agent, or Firm*—Harold H. Dutton, Jr.

[57] ABSTRACT

A device for carrying a concealed weapon comprising first and second flexible fabric panels, overlying the other, the panels being releasibly secured to one another in an overlying relationship; a holster is securely and removably secured to one of the panels and covered by the other of the panels, thus concealing and cushioning the weapon; the panels are joined along a common edge, and releasably connected along at least two other edges thereof in such a manner that the panels may be quickly separated to reveal the holster and enable removal of the weapon by the wearer.

11 Claims, 3 Drawing Sheets

WEAPON CONCEALMENT SYSTEM

This invention relates to a weapon concealment system, and a garment incorporating the same. More particularly, the invention relates to a system for carrying a weapon such as a pistol concealed in an article of clothing, such as a jacket, yet permitting ready access to the weapon as may be needed.

BACKGROUNDS AND OBJECTS OF THE INVENTION

The substantial increase in crime in the United States, coupled with the changing nature of criminal investigative work, has created an unprecedented demand for undercover investigations by police, governmental officials and private security firms. In such instances, it is imperative to have convenient, effective methods of carrying a concealed weapon, since open display of the weapon would immediately compromise the officer's undercover status and failure to carry a weapon could compromise the officer's safety.

A variety of holsters are currently available for police or government officers, but most have great drawbacks for undercover work. The most familiar is a belt-mounted holster, and a variety of such holsters are available for carrying either inside or outside the belt, mounted either high or low relative to the belt. While a belt attached holster is often used in undercover work in conjunction with a long jacket, it is largely unsuited for undercover application. First, police and military typically carry belt mounted holsters, thus criminals routinely examine the waist area for weapons. Also, anyone discovered carrying a weapon in this fashion would be immediately considered a law enforcement officer, a characterization that can be lethal in the context of undercover work.

Second, a weapon carried on the hip invariably creates a noticeable bulge in the profile of the jacket, thus disclosing the presence of the weapon. This is particularly so in the case of weapons of size normally used for duty weapons such as 9 mm, 40 or 45 caliber, semi-automatic handguns.

Third, the covering jacket may shift position or even blow in the wind and reveal the presence of the weapon, thus revealing the 'concealed' weapon and possibly compromising the officer's safety. While a jacket may be securely fastened in front to prevent the weapon from being seen, this precaution also restricts the quick access to the weapon that is such a necessity in undercover work, and tends to accentuate the bulge referred to above.

Another type of holster commonly used is the shoulder holster. This type of holster includes a harness worn by the user, and the weapon is carried in a holster attached to the harness beneath one arm, generally in the area of the armpit of the used. Generally, firearms mounted in shoulder holsters are "cross drawn", that is a right handed user carries the weapon in the region of his left armpit. When fitted under a jacket, the shoulder holster provides improved concealment and wearer comfort. However, shoulder holsters do have some significant drawbacks. The shoulder holster must be used in conjunction with a jacket, and thus is still subject to the drawback that it might open due to wind or even normal body movement to reveal the weapon. In addition, removing the weapon from the holster sometimes requires an awkward cross-body arm movement.

A third type of holster is the ankle holster. This design offers a high degree of flexibility and concealment. However, access is particularly problematic. In many undercover investigations, violence is such a real possibility that the officer would prefer to have his hand a short distance from the weapon at all times. While this is difficult with a shoulder holster, it is almost impossible with an ankle holster. In addition, ankle holster can usually be used only with small caliber, small frame handguns which often have limited magazine capacity and firepower.

A drawback which exists with all prior concealed weapon holsters is the discomfort associated with them. The belt mounted holsters in particular are uncomfortable for a user sitting down, running or driving a vehicle.

The present invention is a system for carrying a concealed weapon such as a revolver or semi-automatic pistol, along with other items such as, for example, additional magazines for the weapon.

A primary object of the invention is to provide an improved type of concealment for weapons such as revolvers and semi-automatic pistols.

Another object is to provide a concealment system which is a lightweight, inexpensive alternative to conventional holsters.

Still another object is to provide a weapon carrying system which offers a high degree of concealment, and has the size and capacity to accommodate even large bore handguns, while being easily accessible to the officer.

A further object of the invention to provide a concealment device which can be used alone or, preferably, incorporated into a garment. The carrying device should be amenable to being manufactured from differing materials so as to be appropriate for the wide variety of settings in which undercover operations might need to be conducted.

DESCRIPTION OF THE INVENTION

The present invention comprises a system for carrying and concealing a weapon, and additionally spare magazines or additional ammunition for the weapon. The invention comprises first and second flexible fabric panels. The panels are preferably joined along one edge which serves to hingedly connect the two panels, and the panels are releasibly secured to one another in an overlying relationship along at least one additional edge thereof. Preferably the releasable securing is accomplished by means of a hook-and-loop fastener. A holster is secured to one of the panels and the other of said panels, and the other panel thus overlies the weapon, concealing it from from view. When the weapon is needed, a pull strap is used to separate the panels and reveal the holster containing the gun.

The panels are so shaped as to conform to the front panel of a jacket or coat, and are intended to be attached to the inside of an article of clothing such as a jacket. The panel may be removably attached or permanently secured inside the garment. This may be accomplished, for example, by sewing the first panel to the inside of the garment. Alternative fastening systems may be used such as snaps, buttons, adhesives or hook-and-loop fasteners. In this manner, the garment, the holster and the inner panel all cushion the outer side of the weapon, and with different thicknesses of panel, the cushioning may be such as to not merely hide the weapon from view, but also to mask the shape thereof.

In addition, this arrangement provides a far greater degree of wearer comfort than is available with prior holster systems. The weapon is directly in front of the wearer, rather than to one side, making access easy.

The holster itself is secured to the inner panel by means of two attaching straps, orthogonally arranged, which securely hold the holster in position inside the sheath formed by the two panels. These straps enable positioning the holster to be carried with the weapon in a variety of positions, pointing up, down or to one side, making the position of the weapon a matter of choice for the wearer. In addition, further straps may be provided for securing spare magazines, speed loaders, ammunition, etc. adjacent the holster and readily available.

Thus, the present invention overcomes the disadvantages of the prior concealment devices, and offers high degree of concealment as well as comfort and security. The device may be incorporated into a jacket or may be used as a separate carrying device. The device may be incorporated into any type of jacket, for example "bomber jackets," sportcoats, windbreakers, etc., thus allowing its use in a variety of undercover operations, depending on the social setting. The device is large enough to accommodate large frame weapons such as .45 caliber automatics. Thus, the device is highly versatile, lightweight and comfortable and allows effective concealment, and can be manufactured at low cost.

BRIEF DESCRIPTION OF THE DRAWINGS

The invention having been described in its general form, the objects and advantages of this invention will become apparent from the detailed description of the invention which follows, in reference to the accompanying drawings which show by way of nonlimiting example, one embodiment of the invention, and in which.

DETAILED DESCRIPTION OF PREFERRED EMBODIMENTS

Figure 1:
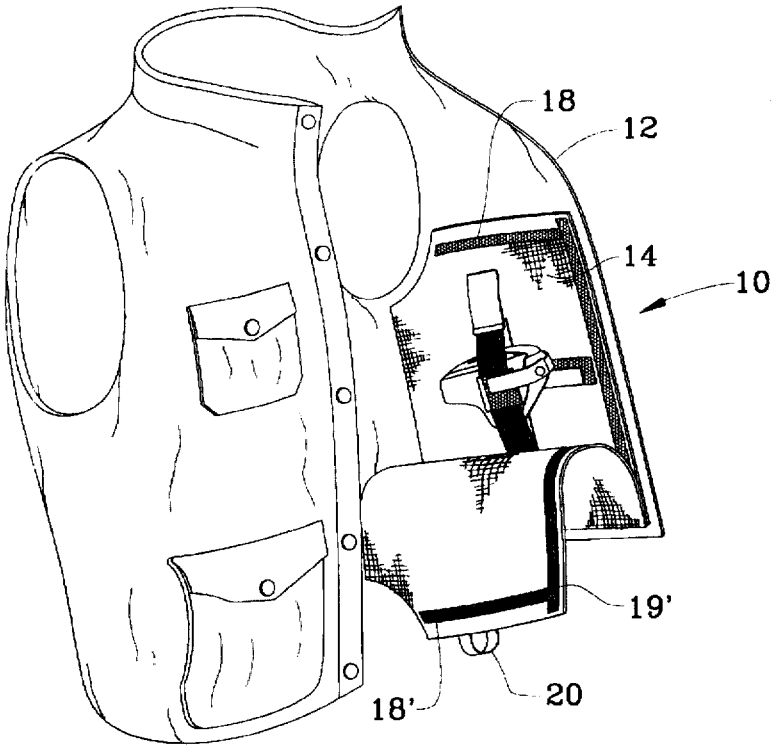
FIG. 1 is a perspective view of a concealment system according to the present invention incorporated into a vest, with one of the panels partially pulled down to reveal a holster.

The invention will now be described in greater detail with reference to FIG. 1 wherein a concealment device generally designated 10 is incorporated into a vest 12. While a vest has been shown, it will be clear that the system may be incorporated into any sort of garment, formal or informal, male or female, thus allowing the user to adopt the sort of attire best suited to the needs of a particular user. A first flexible fabric panel 14 is incorporated into the vest 12 by any sort of conventional sewing or attachment means.

A second flexible fabric panel 16 is in an overlying relationship with the first panel 14. In normal use, the two panels overlie one another in order to conceal the weapon, and are retained in overlying relationship by strips of hook-and-loop fastener materials 18, 18' along one edge and 19, 19' along a second edge. A fabric loop 20 may be provided to assist opening the concealment device. The panels 14 and 16 may be separate pieces of fabric, secured as by sewing along a common edge 21, or may be made of one piece of material folded along the edge 21.

In FIG. 1, the second panel 16 has been shown partially drawn back or open to reveal the holster in which the weapon is carried. Snaps closures (not shown) may also be used to releasably secure the two panels in overlying relationship. Pulling on the loop 20 separates the second panel 16 from the first panel 14, thus to allow access to the weapon in the holster.

Figure 3:
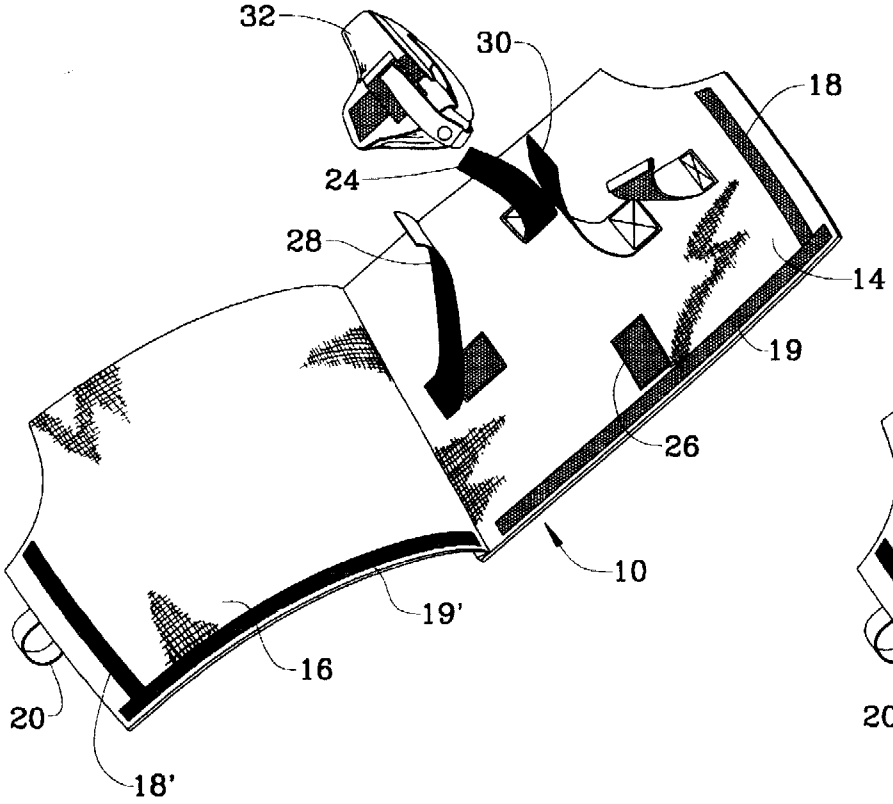
FIG. 3 is an exploded perspective view of the concealment system of FIG. 1 showing the holster removed from the inner one of the panels.

With reference to FIG. 3, the concealment device 10 is shown removed from the garment. The holster 32 is shown to be retained by two generally orthogonal pairs of cooperating straps, 24, 26 and 28, 30. One pair of straps 24, 26 fits through the belt loop of the holster 32 and provides a first point of attachment between the holster 28 and the flexible fabric panel 14. The second pair of straps 28, 30 fit over the holster and provides a second point of attachment to the panel 14.

Figure 4:
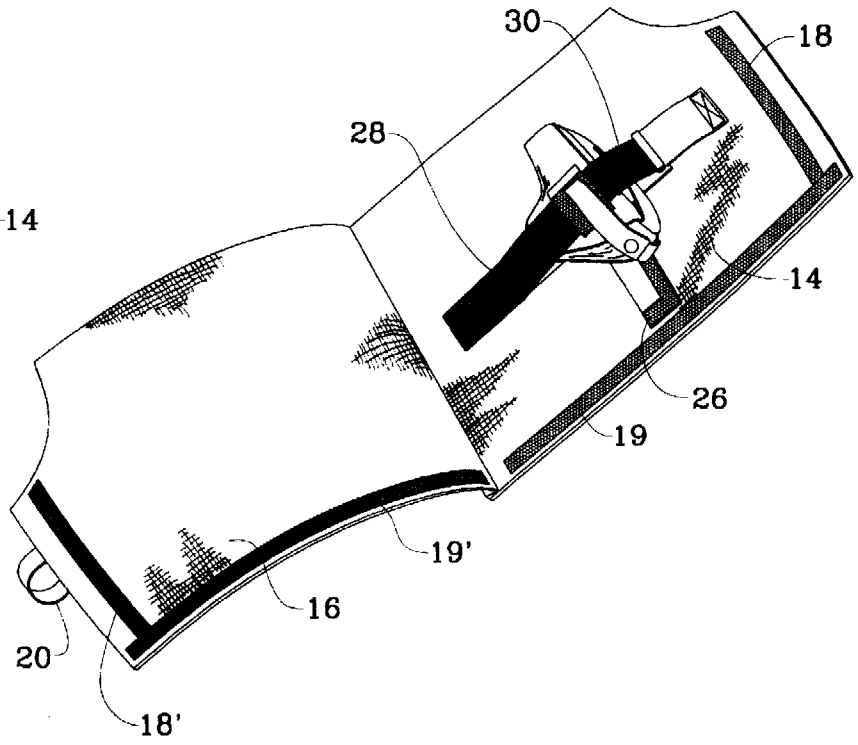
FIG. 4 is a perspective view of the carrying device of FIG. 3 showing the holster secured in position therein.

As shown in FIG. 4, the holster 32 is positioned so that the handgrip of a pistol (not shown) will be generally parallel to the straps 28, 30, and the fastener strip 19 in the carrying device 10. In this particular embodiment, the securing straps 24, 26, 28 and 30 are of hook and loop material. The holster may also include a safety retention strap 36 which secures a pistol in the holster and is made of a hook and loop material that attaches to a side of the holster also bearing hook and loop fabric. The safety strap of the holster acts to prevent the weapon from sliding out of the holster during rapid movement. In the present embodiment, the second strap 26 fits over the holster.

Figure 2:
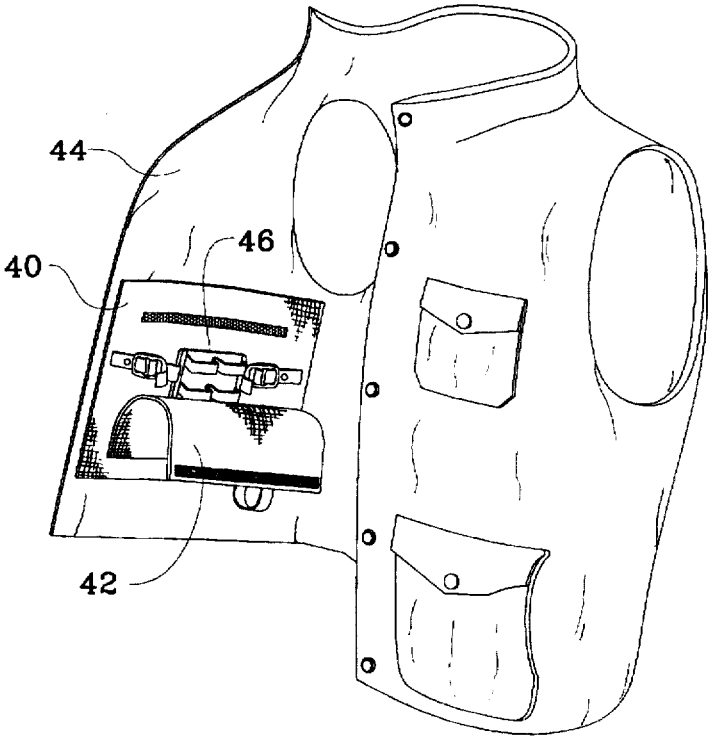
FIG. 2 is a perspective view of an alternative form of the invention incorporated into a vest, with one of panels drawn back to reveal spare magazines.

FIG. 2 illustrates an alternative embodiment of the concealment system according to the invention. In this embodiment, first and second panels 40, 42 are provided, and the inner panel 40 is secured to the inside of a garment 44, again as by sewing or the like. Instead of a holster, a carrier for spare magazines 46 has been provided.

Figure 5:
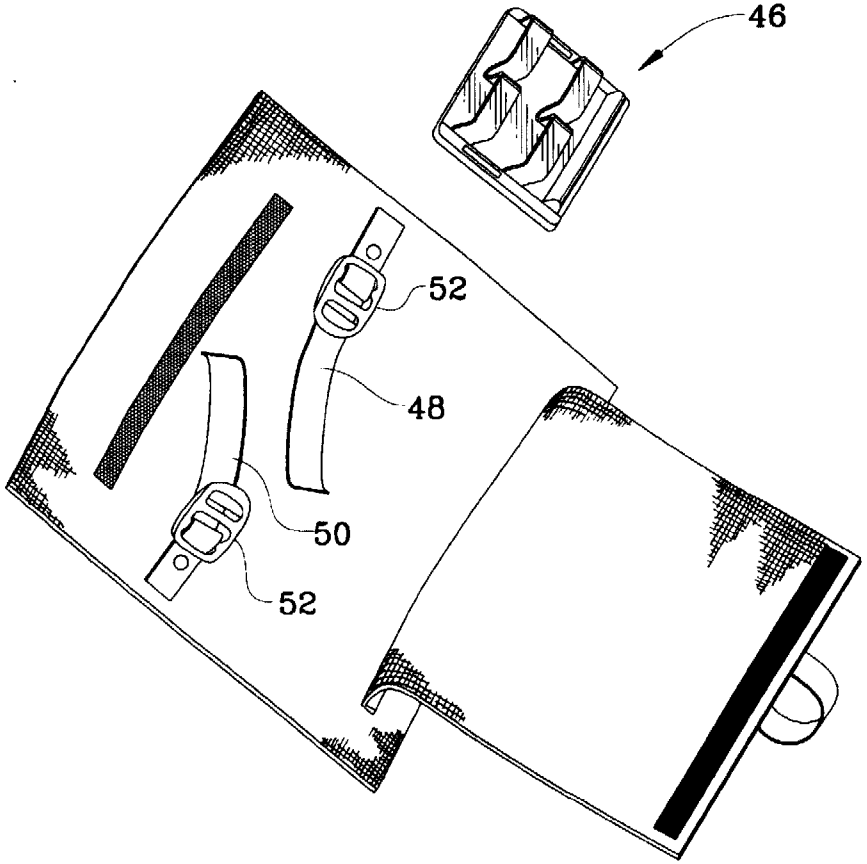
FIG. 5 is an exploded perspective view of the concealment device of FIG. 2 for carrying magazines.

As shown in FIG. 5, the magazine holder 46 is secured again by securing straps 48, 50 threaded through the magazine holder 46 and retained together by buckles 52. However, fastening devices may be used here as well, such as the hook-and-loop type of fastener shown above.

Figure 6:
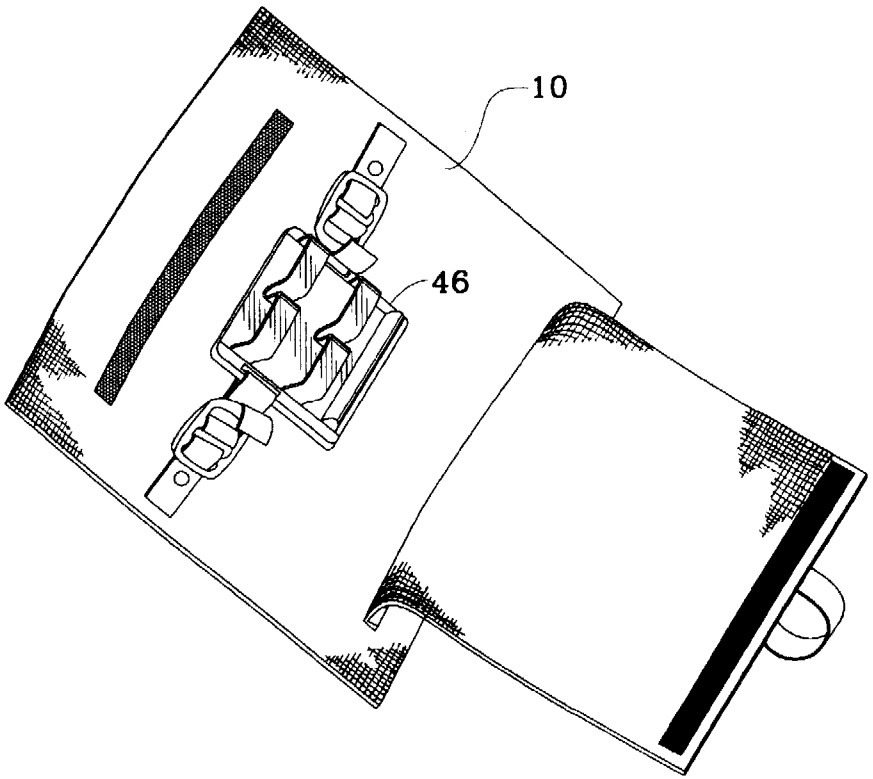
FIG. 6 is a perspective view of the device of FIG. 5 with the magazine carrier secured in position.

FIG. 6 depicts the carrying device 10 fitted with the magazine holder 46. Spare magazines are inserted into the holder in a transverse fashion, so as to allow easy access to the magazines should they be needed. Similar strap arrangements may be provided to secure other devices such as handcuffs, speedloaders, ammunition or the like in the concealment system. Clearly the versatility of the concealment system described herein adds to the significance of the present invention.

While this invention has been described as having certain preferred features and embodiments, it will be understood that it is capable of still further variation and modification without departing from the spirit of the invention, and this application is intended to cover any and all variations, modifications and adaptations as may fall within the spirit of the invention and the scope of the appended claims.

I claim:

1. A weapon concealment system comprising first and second flexible fabric panels secured together along one edge thereof so that one of said panels overlies the other, means for releasably securing said panels in an overlying relationship, releasable article retaining means comprising two orthogonal pairs of releasable straps secured to one of said panels and covered by the other of said panels, a holster secured to said first panel by said releasable article retaining means and hand strap means secured to said second panel for facilitating separation of said panels for providing access to said article retaining means.

2. A weapon concealment system as in claim 1 and including an upper body garment, said first panel being secured inside of said garment.

3. A weapon concealment system as in claim 2 and wherein said one edge of said panels is the lowermost edge of each of said panels, and said hand strap is attached to said second panel along the uppermost edge thereof.

4. A weapon concealment system as in claim 1 and including a magazine holder secured to said first panel.

5. A weapon concealment system as in claim 1 and including a magazine holder secured to said first panel.

6. A weapon concealment system as in claim 1 and wherein said garment comprises a jacket.

7. A weapon concealment system as in claim 1 and wherein said garment comprises a vest.

8. A weapon concealment system as in claim 1 and wherein said releasable securing means comprises hook-and-loop fastening material along at least one edge of said panels.

9. A garment for carrying a concealed weapon comprising a body encircling portion of flexible fabric openable along the front and having a weapon concealment device secured inside said body encircling portion, said weapon concealment device comprising first and second flexible fabric panels secured together along one edge thereof so that one of said panels overlies the other, means securing said first panel inside of said body encircling portion, means for releasably securing said panels in an overlying relationship, releasable holster retaining means secured to said first panel and covered by said second panel, and means for facilitating separation of said panels for providing access to said article retaining means.

10. A garment for carrying a concealed weapon as in claim 9 and wherein said garment comprises a jacket.

11. A garment for carrying a concealed weapon as in claim 9 and wherein said garment comprises a vest.

* * * * *